US005785354A

United States Patent [19]

Haas

[11] Patent Number: 5,785,354

[45] Date of Patent: Jul. 28, 1998

[54] SELF-EXPIRING IDENTIFICATION BAND

[75] Inventor: David J. Haas, Suffern, N.Y.

[73] Assignee: Temtec, Inc., Suffern, N.Y.

[21] Appl. No.: 643,316

[22] Filed: May 6, 1996

[51] Int. Cl.[6] ..... B42D 15/00

[52] U.S. Cl. ..... 283/74; 283/75; 283/95; 283/114

[58] Field of Search ..... 283/74, 75, 95, 283/114, 98, 101, 86; 40/633, 665, 6; 368/327

[56] References Cited

U.S. PATENT DOCUMENTS

| | | | |
|---|---|---|---|
| Re. 30,786 | 11/1981 | Wiebe | 40/665 |
| 3,197,899 | 8/1965 | Twentier | 40/633 |
| 4,386,795 | 6/1983 | Charles et al. | 283/75 |
| 5,184,848 | 2/1993 | Itoh et al. | 283/86 |
| 5,279,057 | 1/1994 | Melin et al. | 40/633 |
| 5,319,457 | 6/1994 | Kay et al. | 283/86 |
| 5,446,705 | 8/1995 | Haas et al. | 368/327 |

FOREIGN PATENT DOCUMENTS

| | | | |
|---|---|---|---|
| WO 93/00669 | 1/1993 | WIPO | 283/93 |

*Primary Examiner*—Willmon Fridie, Jr.

*Attorney, Agent, or Firm*—Michael E. Zall

[57] ABSTRACT

An identification band is provided which includes an elongated band having an outer surface, an inner surface and first and second ends. A first chemical composition, e.g., a soluble ink, is distributed on the outer surface of the band proximate the first end. A display region is disposed in the band proximate the second end. A second chemical composition, e.g., an adhesive ink activator is distributed on the inner surface of the band overlying the display region proximate the second end. When the band is wrapped around an object, e.g., a user's wrist, with the outer surface exposed, the outer surface of the first end and the inner surface of the second end overlay and are in contact, preferably in adhesive contact, with each other. The first and second chemical compositions coact with each other to cause a visually perceptible change in the display region after a predetermined time interval. Such visually perceptible change is viewable from the outer surface.

10 Claims, 5 Drawing Sheets

SELF-EXPIRING IDENTIFICATION BAND

BACKGROUND OF THE INVENTION

1. Field of the Invention

This invention relates to self-expiring identification bands. In particular, this invention relates to an identification wristband wherein after a predetermined amount of time has elapsed from the initial activation of the band, the band exhibits a visual signal which can be easily and rapidly viewed.

2. Prior Art

It is the customary practice in hospitals to identify patients for various purposes with bracelets or bands incorporating a patient name, a patient number or other identifying information. Similar bracelets or bands are used for patron identification at concerts, amusement parks, ski lifts, or other ticketing applications.

Generally, there are several types of identification bands, e.g., wristbands. One type of identification band includes colored strings that are clipped around a wrist. Other types of identification bands are paper bands with adhesive on at least one end for securing around a wrist, non-woven bands, e.g., TYVEK®, with adhesive at one end for securing around a wrist, and plastic bands with mechanical one-way snaps for securing around a wrist.

A primary attribute of such identification bands, compared to other types of identification means such as tickets and passes, is that the bands cannot be transferred between persons without breaking, cutting or otherwise tampering with the band. Most identification bands include a tamper-evident means. This feature makes it easy to detect and prevent, for example, a person from giving their identification wristband to another person. Such tamper evident means also prevents a person from using the wristband on one occasion, removing it and thereafter reusing it on another occasion.

Such identification bands are, however, not completely fool proof. For example, wristbands can be cut and removed from the wrist and, at some future time, reattached to the wrist by, for example, gluing the band together at the point of cutting. Such tampering may be difficult to detect. Attempts to overcome this abuse have been made. For example, a different color wristband may be issued each day in order to prevent the wristband from the previous day from being reused. This, however, does not prevent people from keeping one color wristband and reusing it on another day when the same color is being used. It is even common for people to collect wristbands of different colors for such purpose. Such misuse is made easier due to the fact that many locations use similar colors for wristbands.

Numerous attempts have been made to overcome some of these problems, as well as other disadvantages of known wristbands. See, for example:

U.S. Pat. No. 3,197,899 to Twentier which describes an identification band having a transparent material secured to the band to protect the identifying markings on the band.

U.S. Pat. No. 4,386,795 to Charles et al which describes an identification band having various means for providing identifying indicia.

U.S. Pat. No. 4,314,415 to DeWoskin which describes identification bands, particularly for use in hospitals. The bands are made of a plurality of tapes laminated together by pressure-sensitive adhesive. The bands include a transparent tape as an outer tape, with an insert underlying the transparent tape which has preprinted identification indicia on its face facing the transparent tape.

U.S. Pat. No. 4,612,718 to Golub et al which describes an identification band for identifying patients. The band includes a base layer formed of a tear-resistant, water-proof, ink-receptive material. The base layer includes an eyelet section, an information section and a tongue section. A slot is formed in the eyelet section and several means are described to connect the tongue section to the eyelet section.

U.S. Pat. No. 4,914,843 to DeWoskin which describes an identification band comprising a backing strip that has a pressure-sensitive adhesive thereon, release strips on the adhesive, and an overlying transparent strip. One of the release strips is removable for application of a pre-printed insert to the backing strip. The insert is then covered by the transparent strip. The other release strip is removable for adhering the tongue to the backing strip at the other end thereof.

U.S. Pat. No. 4,991,337 to Solon which describes a disposable identification bracelet formed from a strip of thin, but tough, flexible material that has identification indicia on its top side, defining locations for receipt of variable information that may be placed thereon by pen, pencil, typewriter or the like. The opposite sides of the strip have bodies of pressure sensitive adhesive whereby the ends may be overlapped and secured together.

U.S. Pat. No. 5,026,084 to Pasfield which describes a color coded band, adapted to be mounted on the arm of a patient. The band has a highly visible color code to indicate a certain care alert condition. The band is of synthetic paper and has adhesive on at least one end. The bands may be computer processed by mounting them on a length of pin feed computer paper. Charts for the color coded alert condition arm bands are provided.

U.S. Pat. No. 5,364,133 to Hofer et al which describes an identification bracelet formed of layers of flexible material removably laminated with a selectively printed release layer and a pigmented adhesive. One layer has a plurality of die cut areas which can be removed to expose a portion of the adhesive, which is then overlapped with, and attached to the other layer. The adhesive is applied over a selectively printed release layer so as to have areas of high adhesion and areas of low adhesion to the upper layer which separate differentially and form a "void" indication, for example, if the attached ends are separated after application.

Time indicator devices are also known in the art. Such devices provide a visual indication of the passage of a predetermined amount of time. Such time indicators are useful, for example, as security badges or as a means for determining the length of time a perishable item, e.g., food, photographic film, etc., has been on a wholesaler or retailer shelf.

Many of these known time indicators, which are generally short term time indicators, are based on the migration of ink from one substrate through another substrate, i.e. in a path perpendicular to the surface of the substrate. After the ink migrates through the substrate(s) it is viewed on a display surface to thereby indicate that the predetermined time has elapsed. Other known time indicators are based on the migration of liquids, jellies or inks through wicks or migration paths to indicate the passage of time. Still other indicators rely primarily upon chemical reactions to cause a visually perceptible change over a desired time period rather than the migration of fluids or compounds.

More specifically:

U.S. Pat. No. 4,212,153 to Kydonieus, et al describes a laminated indicator that changes in a visually perceptible mode with the passage of time. The indicator comprises at least two layers whereby the molecular migration of an agent in an interior layer to the outermost surface of the exterior layer causes a change which is visually perceptible.

U.S. Pat. Nos. 4,432,630, 4,542,982 and 4,779,120 to Haas describe badges with an ambient light sensitive coating thereon which when exposed to ambient light for a specified period of time change to a specified color.

U.S. Pat. No. 4,903,254 to Haas describes a time indicator with a plurality of layers that are adhered together. The indicator has a front part and a rear part. The rear part includes an ink film layer upon a backup layer. At issuance, the front part and rear part are adhered together and the ink migrates from the rear part into the front part.

U.S. Pat. No. 5,058,088 to Haas describes a timing indicator type badge, label or display wherein the relative amount of time that has elapsed from the initial activation of the timing indicator can be easily determined by the progression of a visually perceptible change in color along different areas of the timing indicator. This timing indicator comprises a clear self-adhesive film which is placed over a printed substrate in order to activate the timing indicator. The printed substrate includes a migrating or soluble ink which migrates along the substrate to produce a visual color change.

U.S. Pat. No. 5,107,470 to Pedicano describes a quick acting indicator including a migrating ink that migrates through an opaque layer to display a message. Upon removal of a release paper, a coated indicator portion is brought into contact with a printed base portion, and a printed message migrates through a noncuring layer to display the printed message.

U.S. Pat. No. 5,364,132 Haas et al. describes a reusable self-expiring security identification badge. When the badge is issued, the inked substrate is attached to the base substrate, the inked substrate covering the void indicia area. The overlay substrate is then placed over and attached with the soluble ink of the ink substrate. The ink dissolver of the overlay substrate contacts and co-acts with the soluble ink of the inked substrate to dissolve the ink and allow the ink to migrate through to the overlay substrate to the display surface, where it can be visually perceived, in a preselected time interval.

U.S. Pat. No. 5,446,705 to Haas et al describes a time indicator that changes color or produces an image or information after a specific time interval. The time indicator includes a base with color dye deposited on a first surface; and a substrate having an adhesive on a first surface thereof, the adhesive positioned at discrete locations on the first surface of the substrate. When the substrate and the base are put into adhesive contact with each other, the adhesive contacts and coacts with the colored dye to dissolve the dye and permit the dye to migrate through the adhesive to cause a color change visible through the substrate. The discrete adhesive inhibits lateral migration of the dye to preserve the image or information of the dye in a clear and/or understandable condition. The time indicator badge can be an admission bracelet or wristband that self-expires after a time interval.

Although not necessarily prior art, Applicant herein has several pending patent applications relating to time indicators:

U.S. Ser. No. 07/602,120 filed on Oct. 22, 1990, now U.S. Pat. No. 5,719,828, to Haas (3.0-011/CIP) describes a patterned indicator that contains latent information. The indicator includes a first substrate having first and second surfaces, the first surface having a uniform pattern printed with an ink thereon. A second transparent substrate having first and second surfaces is also provided having on the first surface thereof an adhesive activator. The indicator is activated by placement of the first surfaces of the substrates into adhesive contact such that the ink and adhesive activator coact to cause the ink pattern to gradually bleed and blend together to cause a change visually perceptible through the transparent substrate in a selected time interval.

An embodiment described in Haas (Ser. No. 07/602,120) is a wrist band ticket. The wristband described includes an elongated flexible substrate that has a pattern printed thereon. The pattern may be printed of soluble and insoluble inks. A transparent film is anchored at one end of the substrate and extends a short distance beyond the other end. The film has an adhesive coated underside, which is covered by a liner prior to use. Upon activation, the liner on the transparent film is removed to expose the adhesive underside of the film. The transparent film is then placed in adhesive contact with the substrate. The wrist band is fastened around the wrist of the purchaser; the length of the adhesive film extending past the substrate is used to secure the ends of the substrate together around the purchaser's wrist. The latent information contained in the pattern on the wrist band is brought forth, usually in the time period of one day, resulting in, typically, the word "expired" being visible along the circumference of the wrist band.

A problem associated with this wristband is that the band material must be carefully selected to be compatible with the time indicator system, thus typical and standard materials of construction and band structure are difficult to use. For example, a typical wristband whether it is made out of paper, non-wovens, or plastic, is generally impervious to dyes and organics from penetrating directly through the band.

U.S. Ser. No. 07/771,765 filed on Oct. 4, 1991, now U.S. Pat. No. 5,699,326, to Haas (3.0-013) describes a time indicator having a front part and a rear part. The rear part includes an ink pattern layer overlaying a rear support member. The front part includes a transparent front support layer, an opaque adhesive layer capable of dissolving the ink pattern on the rear part, and a front ink display surface. When the front part is contacted with the rear part by applying the opaque adhesive layer onto the ink pattern, the adhesive layer activates the dissolution and migration of ink in a selected time interval from the ink pattern layer, through the opaque adhesive layer to the front ink display surface for viewing through the transparent front support layer.

U.S. Ser. No. 07/955,469 filed on Oct. 2, 1992, now U.S. Pat. No. 5,715,215, to Haas (3.0-015) describes an identification badge having a base coated with an adhesive protected by release paper. The badge is assembled by removing the release paper, placing an identification card into contact with the adhesive, and then attaching a fastener through a slot in the base of the badge. A timing indicator can be incorporated into the badge so as to show the expiration of the badge after a selected period of time.

U.S. Ser. No. 08/197,631 filed on Feb. 10, 1994, now U.S. Pat. No. 5,633,835, to Haas (3.0-017) describes a time indicator that rapidly changes color after a specific time interval. The time indicator includes a base substrate with colored dye deposited on a first surface; a barrier applied over the colored dye; and a substrate having an adhesive on a first surface thereof. The substrate and the base substrate are put into adhesive contact. The adhesive coacts with the barrier to dissolve the barrier in a specified time interval. The adhesive then contacts the colored dye to dissolve the dye and permit the dye to migrate through the adhesive to cause a color change visible through the substrate.

U.S. Ser. No. 08/510,762, filed on Aug. 3, 1995, now U.S. Pat. No. 5,602,084, to Haas (3.0-019) describes a time indicator device having a display layer with a display region therein. A migration layer is provided which overlies and is attached to the display layer. The migration layer has a migration region therein that is in contact with the display region. An activation layer is provided which has an activation region therein that includes a migrating agent capable of migrating laterally through the migration region. When the activation layer overlies the migration layer, the activation region overlies the migration region. The migration region connects the activation region with the display region which is laterally distal from the activation region. In order to activate the device, the activation layer and migration layer are adhesively attached to each other. When the activation layer is contacted with and overlies the migration layer, the activation region contacts the migration region. Upon contact the migrating agent is activated to migrate laterally from the activation region through the migrating region to the display region in a predetermined amount of time to cause an indication in the display region that the predetermined amount of time has elapsed. The device may have a plurality of display regions, activation regions and/or migration regions to provide a means for adjusting the predetermined time, adjusting for environmental conditions and to provide a plurality of elapsed times.

U.S. Ser. No. 60/064,090 to Frommer, et al filed Sep. 21, 1995 (provisional application, 3.0(PROV)-024) now U.S. Ser. No. 08/718,268 filed on Sep. 20, 1996 describes an indicator badge and system for electrically monitoring identification of persons. The badge of the system includes a substrate with a metallic film or a metal foil disposed thereon that is oxidized or chemically depleted to (i) cause a color, reflectivity or opacity change, (ii) show an underlying security symbol or pattern, i.e. the color red or "void", (iii) change the electromagnetic properties of the badge to indicate whether the badge is valid or expired. The elements of the badge are kept separate from each other until the time of activation, at which time they are brought together or laminated to produce a slow change in the metallized film to bring about the indicator stage.

OBJECTS AND SUMMARY OF THE INVENTION

It is an object of this invention to provide an identification band which is inexpensive and can clearly and relatively accurately indicate the lapse of a selected period of time.

It is a further object of this invention to provide a self-expiring or self-canceling identification band that cannot be reused or counterfeited.

It is another object of this invention to provide a identification band that can provide the user with a clear indication of the time that has elapsed since activation of the device.

It is still a further object of this invention to provide a self-expiring identification band which enables a person to determine visually from a relatively long distance whether the identification band has expired.

It is still another object of this invention to provide an identification band which is disposable and cannot be transferred from one person to another.

It is another object of this invention to provide a self-expiring pass, including admission tickets for parks, theater and other events that expires upon the passing of set intervals, e.g. one day, one week, one month etc.

It is a further object of this invention to provide a wristband ticket which self-expires and wraps around the wrist of a person to prevent the transfer of the ticket.

It is yet another object of this invention to provide a identification band visitor pass having a void pattern printed faintly thereon, which, after activation, grows dark to indicate expiration of the pass.

The identification band of this invention includes an elongated band having an outer surface, an inner surface and first and second ends. A first chemical composition, e.g., a soluble ink, is distributed on the outer surface of the band proximate the first end, and preferably along the entire length of the band. A display region is disposed proximate the second end of the band. A second chemical composition, e.g., an adhesive ink activator, is distributed on the inner surface of the band overlying the display region. When the band is wrapped around an object, e.g., a users wrist, with the outer surface exposed, the outer surface of the first end and the inner surface of the second end overlay and are in contact, preferably in adhesive contact, with each other. The first and second chemical compositions coact with each other to cause a visually perceptible change in the display region after a predetermined time interval. Such visually perceptible change is viewable from the outer surface.

The first chemical composition is distributed in a pattern that, upon application of a stimulus or an activator, reveals latent information through the display region of the identification band. Typically the pattern is a uniform array of dots printed on the outer surface of the band. The latent information may be a function of the type dye used for various dots in the array, a function of a mask placed over the pattern, or a function of an application of a patterned activator.

Preferably, the activator is an adhesive substance on a transparent overlaying film. Upon placement of the stimulus or activator onto the pattern, a component of the pattern either coalesces or disappears to reveal the latent information.

A preferred embodiment of this invention consists of a band that is wrapped around a person's extremity, e.g., leg, wrist. The pattern printed on the band includes both migrating and non-migrating components and contains latent information. The transparent display region in the band has an adhesive surface thereon. At the time of issuance of the identification band, the band is wrapped around the wrist. The transparent film display region on one end of the band is adhered to the other end of the band such that the adhesive surface contacts the pattern on the band and the display region is facing outwards. This causes, over a specified time interval, the migrating components to coalesce to reveal through the display region the latent information contained within the pattern indicating, for example, expiration of the band.

In another embodiment, the identification band is a visitor's pass wherein over a period of time, numbers appear sequentially corresponding to passing time intervals.

In still another embodiment, the identification band includes a self-voiding bar code having a background pattern, that, after a predetermined period of time after activation, coalesces so that the bar code is no longer distinguishable.

BRIEF DESCRIPTION OF THE DRAWINGS

While the invention will be described in connection with a preferred embodiment, it will be understood that it is not intended to limit the invention to that embodiment. On the contrary, it is intended to cover all alternatives, modifications or equivalents as may be included within the spirit and scope of the invention.

DETAILED DESCRIPTION OF THE INVENTION

Figure 1:
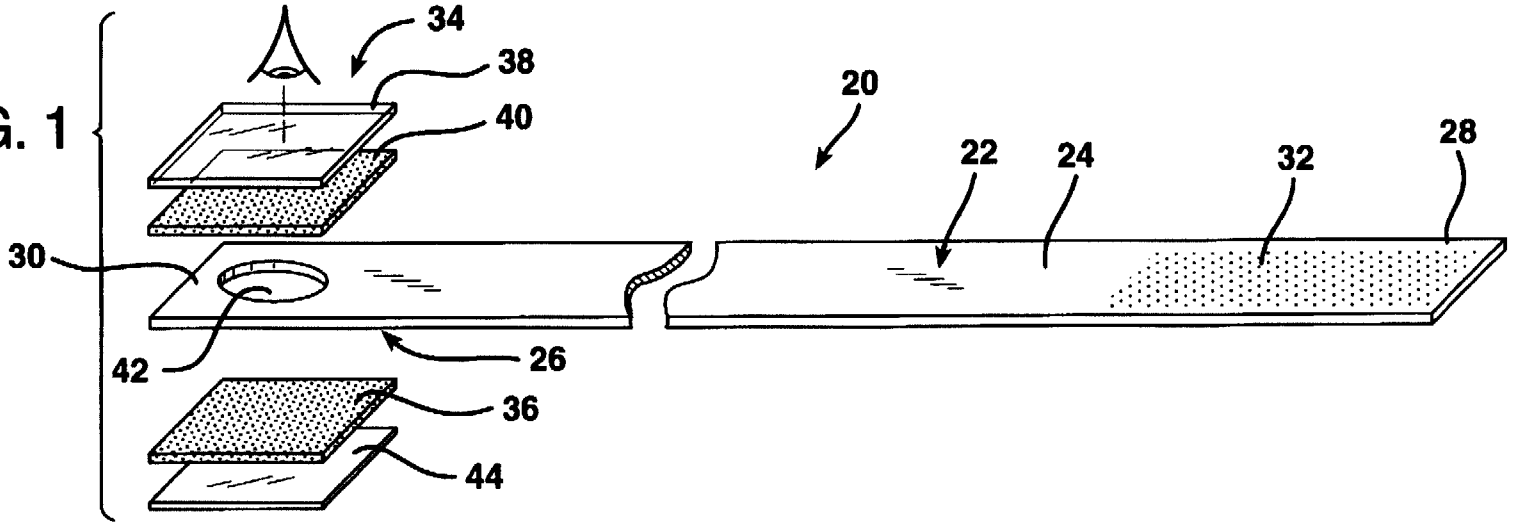
FIG. 1 is an exploded perspective view of the self-expiring identification band of this invention.

Referring to the Figures herein, the identification band 20 includes an elongated band 22. The band 22 may be made of materials typically used for such bands, e.g., paper, non-woven materials, plastics, and is of a length and width suitable for encircling a wrist, arm, ankle, etc. of a person. Typical dimensions are about one inch (1") wide and nine inches (9") long. The band 22 has an outer surface 24, an inner surface 26 and a first end 28 and a second end 30.

Figure 2:
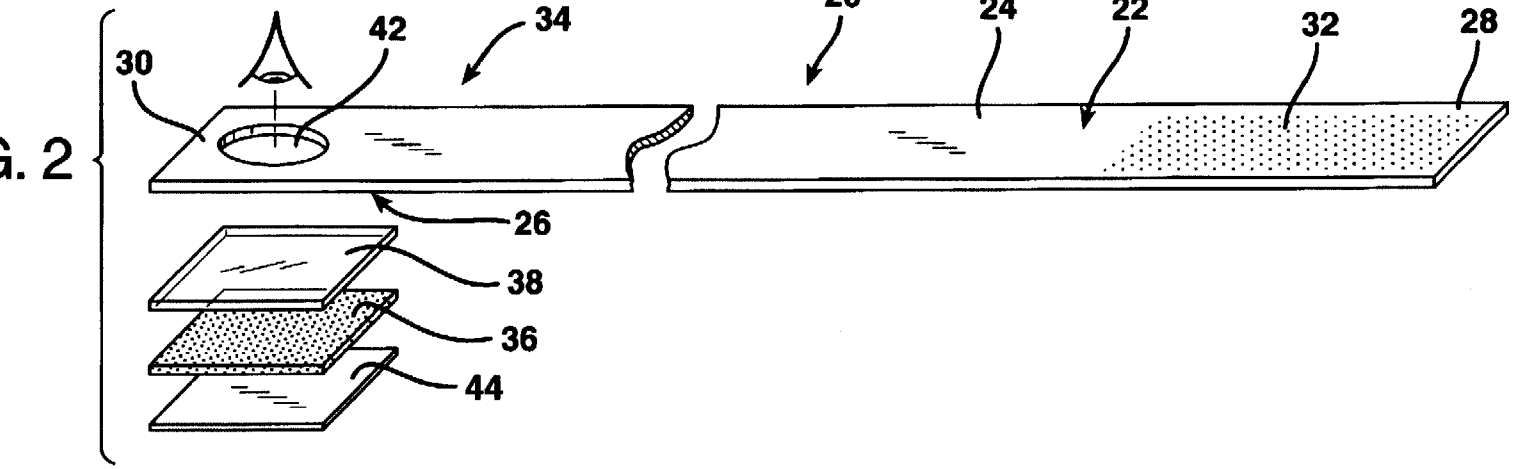
FIG. 2 is an exploded perspective view of another embodiment of the self-expiring identification band of this invention.
Figure 3:
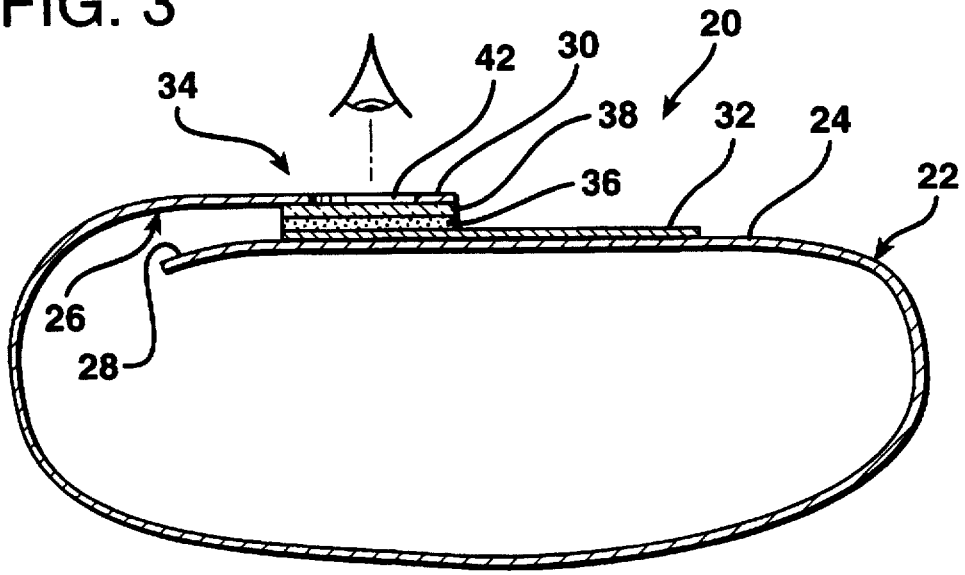
FIG. 3 is a cross-sectional view of the identification band of FIG. 2 in use and activated.

Referring to FIGS. 1–3, a first chemical composition 32, preferably a migrating ink, is distributed in a pattern on the outer surface 24 of the band 22 between the first 28 and second ends 30, and in the embodiments depicted, proximate the first end 28. A display region 34 associated with the band 22 proximate the second end 30. In the preferred embodiments, depicted in FIGS. 1–3, the display region 34 includes an opaque or white viewing layer 38 that absorbs the migrating ink 32 to provide a visually perceptible change therein after a predetermined time interval.

Referring to FIGS. 1–4, a second chemical composition 36 is distributed over the inner surface 26 of the band 22 overlying the display region 34 proximate the second end 30. Preferably, the first and second chemical compositions 32,36 are, respectively, an ink and an ink dissolver, the ink dissolver coacting with the ink to cause a migration of the ink. It is also preferred that the ink dissolver 36 be an adhesive so that when the outer surface 24 of the first end 28 and the inner surface 26 of the second end 30 are placed in contact with each other as shown in FIGS. 3, and 5–7, they become adhesively bound to each other. It is also preferred that the adhesive bond be tamper-evident, i.e., when any attempt is made to undue the bond between the ends 28,30, such tampering provides a visible indication. Such tamper evident bonds are well known in the art.

Figure 4:
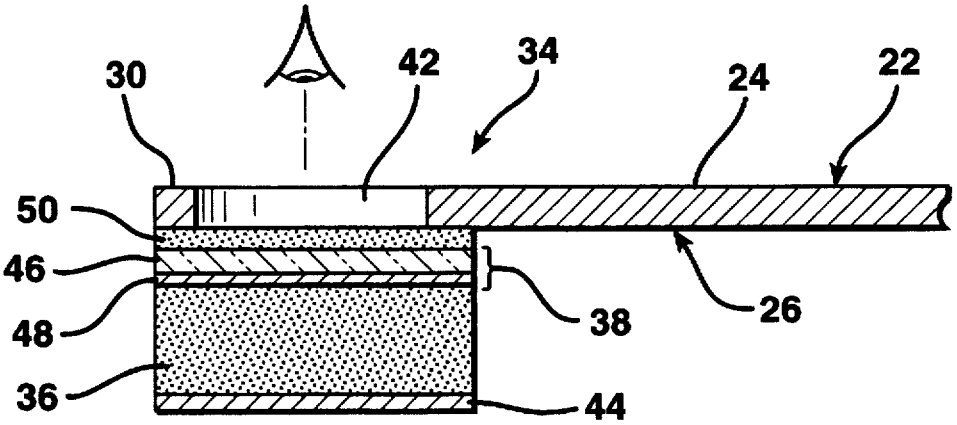
FIG. 4 is a magnified cross-sectional view of another embodiment of the display region used in the identification band of this invention.
Figure 5:
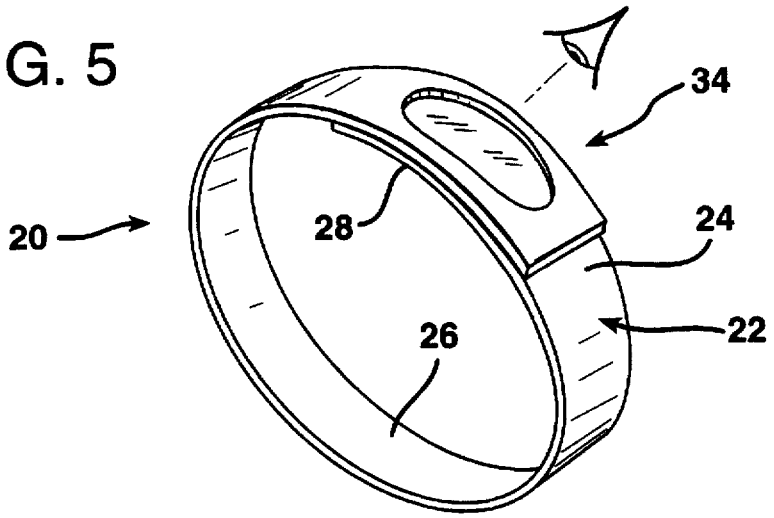
FIG. 5 is a perspective view of the self-expiring identification band of this invention in use.
Figure 6:
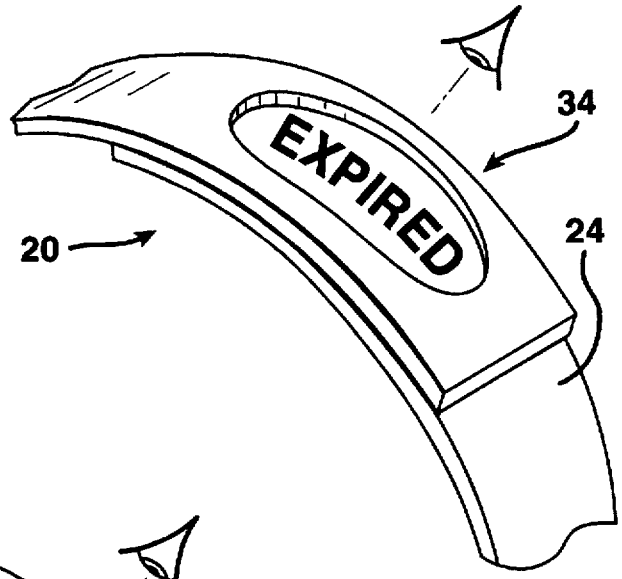
FIG. 6 is a magnified perspective view of the self-expiring identification band of this invention in use after expiration.
Figure 7:
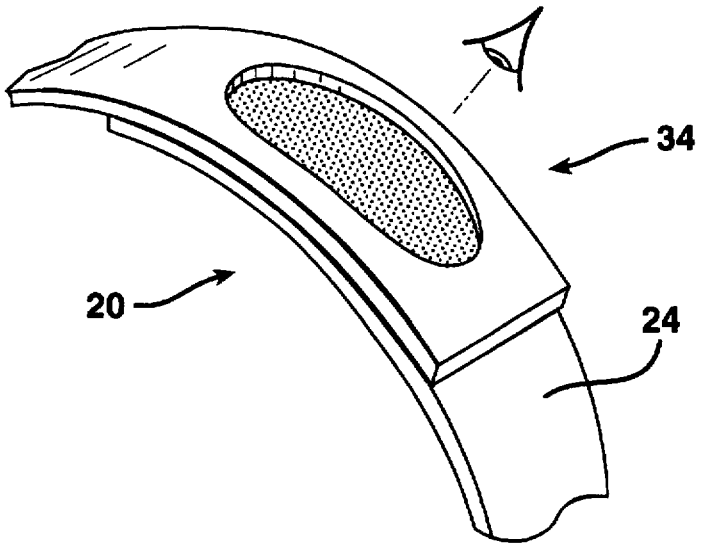
FIG. 7 is a magnified perspective view of the self-expiring identification band of this invention in use prior to expiration.

As shown in FIGS. 3, and 5–7, the band 22, when in use is wrapped around an object, e.g., a wrist, with the outer surface 24 exposed. The outer surface 24 of the first end 28 and the inner surface 26 of the second end 30 are overlaid and placed in contact with each other. Referring to FIGS. 1–3, the first and second chemical compositions 32, 36 when placed in such contact with each other coact to cause a visually perceptible change in the display region 34 after a predetermined time interval. Such visually perceptible change is viewable from the outer surface 24 through the display region 34. Referring to FIGS. 2–4, preferably, a relatively thick layer of extra strong adhesive 36 is applied under a white or opaque viewing layer 38 in order to insure that the bond between the two ends 28,30 of the wristband 20 is permanent and cannot be separated without destroying the wristband 20.

In one embodiment, the ink pattern 32 may be a pattern of dots printed in a preselected pattern. The use of the term "dot" includes not only the usual meaning of the word dot, i.e., a small round point, but also other type small points of ink print, for example triangular, heart shaped, etc. The ink pattern 32 can also be a number indicating time, e.g. 10, 11, etc., or a series of bars producing a bar code. The ink pattern 32 may also be surrounded by a pattern of background dots, preferably of the same color as ink pattern, which do not develop or change over a period of time. The ink pattern may also be a soluble ink pattern which, when placed in contact with the adhesive which includes a solvent for the soluble ink, dissolves the dots so that the dots of the pattern bleed into each other. The background dots may be printed with an insoluble ink and thus they do not bleed together when in contact with the adhesive.

The use of a dot pattern imprinted on the band 22 makes it simple to vary the preselected time of development of the pattern 32 by varying the shape and size of the dots and/or varying the dot-to-dot linear dimension. Depending on the application and times required, one can maintain the same geometric shape and size and vary the dot-to-dot distance of the patterns on indicia areas or keep the dot-to-dot linear distance the same and vary the geometric size and shape and/or vary both of these.

Referring to FIGS. 1–4, upon activation of a wrist band 20, the protective liner 44 on the adhesive 36 is removed to expose the adhesive 36. The wrist band 20 is then fastened around the wrist of the user, for example as shown in FIGS. 3 and 5–7, by adhesive 36 being placed in adhesive contact with the ink pattern 32. The latent information contained in the pattern on the wrist band 22 bleeds through to opaque layer 38, usually in the time period of one day, resulting in, typically, the word "expired" being visible through the display region 34 see FIG. 6. The self-expired wrist band ticket is thus incapable of being transferred for subsequent use at a subsequent time.

In a preferred embodiment depicted in FIG. 1, the band 22 has at least one, and perhaps a plurality of openings 42 through the band 22 to permit the migration of the dye 32 therethrough to opaque layer 38, in order to cause the color change in the display region 34. The "at least one opening" can also be constructed as a series of openings, perforations, group of finely punched holes, microscopic capillaries, a porous structure or, merely a single large opening, through which the dye can pass to be viewed. In this embodiment, the opaque viewing layer 38 is adhesively attached by layer 40 to the outer surface 24 of band 22 proximate the second end 30, with the ink or dye 32 passing thorough the band 22 to be absorbed by the opaque viewing layer 38.

Optionally, as depicted in FIGS. 2–4, the band 22 has one opening 42 therethrough to permit the viewing of the dye 32 therethrough. Optionally, the band 22 may be transparent. In this embodiment, the opaque viewing layer 38 is adhesively attached to the inner surface 26 of band 22 proximate the second end 30. In use, the ink or dye 32 upon contact with the adhesive 36, dissolves and passes through the adhesive 36 and then through the white opaque viewing layer 38 to be viewed through the opening 42 in the band 22. Alternatively, layer 38 may be In the embodiments depicted in FIGS. 1–3, the opaque viewing layer 38 can be a solid opaque film that directly absorbs the colored dye or ink 32 to thereby show a color change upon expiration. Optionally, the layer 38 can be a clear film with an opaque coating on the inner surface between the clear film and the band 22. For example, referring to FIG. 4, the layer 38 can be a clear film 46, such as polyester or polypropylene, with an opaque coating 48 between the clear film 46 and adhesive 36. Layer 38 is attached to the inner surface 26 by adhesive 50.

Optionally, the band 22 may be perforated in any number of places in order to cause it to tear apart when one removes it. These perforations can be in the band 22, under the adhesive 36 and proximate the display region 34 or in the main body of the band 22 to provide a tamper evident band. Such perforations can also serve as a safety device to permit the wristband to break apart if the wearer should catch the band while wearing it.

Depending on the rate of dissolution of the migrating ink 32 by the adhesive 36, the identification band 20 could be used for a few hours, a day, a week, etc. In each case, the relative darkening of the identification band in the display region 34 would show that the predetermined period of time has elapsed since issuing the identification band. (See FIGS. 5–7) The change in color in the display region 34 can be seen from up to, about twenty feet (20') away. Such darkened identification bands cannot be reused and it is difficult to print counterfeit identification bands.

Figure 8:
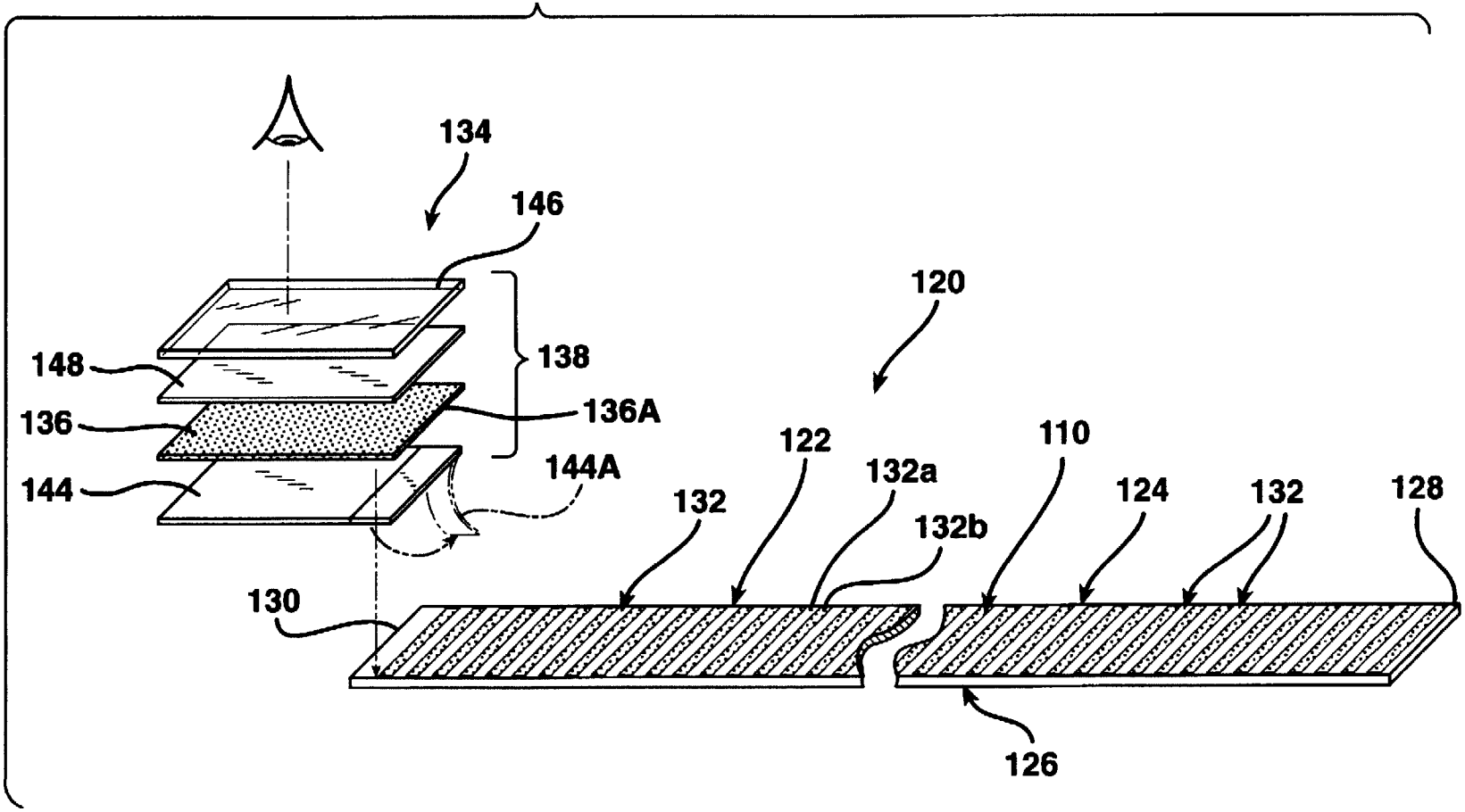
FIG. 8 is an exploded perspective view of another embodiment of the self-expiring identification band of this invention.
Figure 9:
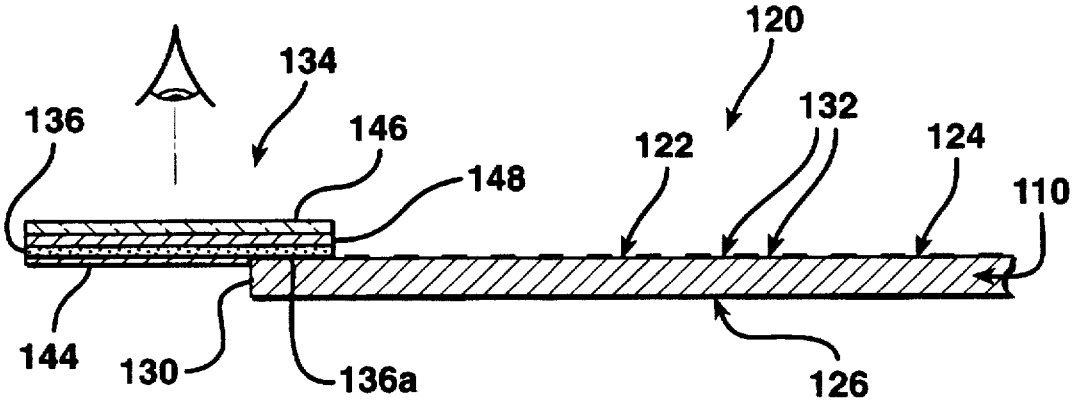
FIG. 9 is a cross-sectional view of the identification band of FIG. 8 just prior to activation.
Figure 10:
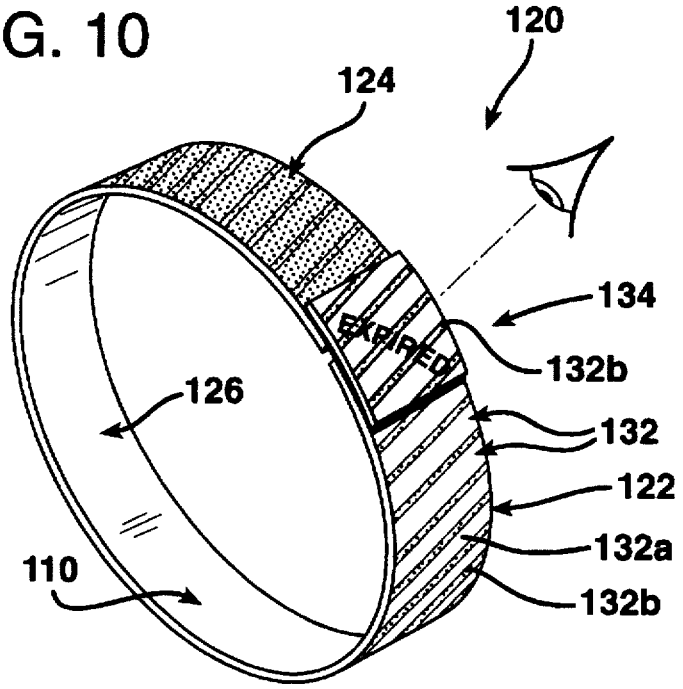
FIG. 10 is a perspective view of the self-expiring identification band depicted in FIGS. 8 and 9 of this invention in use and expired.

Referring to a preferred embodiment depicted in FIGS. 8, 9 and 10 herein, the identification band 120 includes an elongated band 122. The band 122 may be made of materials typically used for such bands, however TYVEK® brand material is preferred. The band 122 has an outer surface 124, an inner surface 126 and a first end 128 and a second end 130.

A migrating ink 132 is distributed in a pattern on the outer surface 124 of the band 122 between the first and second ends 128, 130, and proximate the first end 128. The ink pattern 132 in the embodiment depicted, is a series of bars **132*a*, 132*b* of the same color alternating betweeen ink bars that which do not develop or change over a period of time 132*a* with those that do develop or change over a period of time 132*b*. The pattern 132 can run the complete length of the band 122. Such a pattern can be advantageous in providing a tamper-evident surface. For example, if the appropriate pattern and/or selection of inks is provided in the pattern 132, when the band 122** is cut and an attempt is made to reattach the ends, by for example glue, tape or even staples, the pattern clearly indicates tampering by a disruption of the uniform pattern and/or a bleeding or dissolution of the pattern by the glue or adhesive used to reattach the ends. The pattern may also include a thin holographic line pattern to inhibit counterfeiting of the bands.

Still referring to the embodiment depicted in FIGS. 8, 9 and 10, a display region 134 is associated with the band 122 proximate the second end 130. The display region 134 comprises a layer 138 that includes a clear film 146, such as polyester or propylene, with a clear adhesive layer 136, **136*a*, with an opaque coating 148 between the clear film 146 and adhesive layer 136**.

Referring to FIG. 8, optionally, layer 138 includes a clear film 146, such as polyester or polypropylene film, with a clear dye absorbing layer 148 and an opaque white adhesive 136, **136*a*. In this embodiment, the opaque white adhesive layer 136, 136*a* functions as a migrating ink diffusion time control layer and the clear dye absorbing layer 148** functions as a color enhancement layer. This type of system described in the aforementioned U.S. Pat. No. 4,903,254 to Haas. The entire disclosure of this patent is incorporated herein by reference.

Still referring to FIG. 8, in yet another embodiment, layer 138 includes a clear film 146, such as a polyester or polypropylene film, with an opaque white adhesive 136, **136*a*. This type system elliminates the need for layer 148**.

Referring to FIG. 8, protective liner 144 and protective liner tab **144*a* overlies and protects the adhesive layer 136, 136*a*. The display region 134 is attached to the band 122 by removing protective liner tab 144*a* and applying adhesive layer portion 136*a* over the outer surface 124 at the end 130 of band 122. The band 122 is sufficiently long so that band material will be between the display region 134 and wrist to cushion the wrist with, for example, TYVEK® brand material from the relatively hard plastic display region 134**.

Upon activation of the wrist band 120, the protective liner 144 on the adhesive 136 is removed to expose the adhesive 136. The wrist band 120 is then fastened around the wrist of the user by adhesive 136 being placed in adhesive contact with the ink pattern 132. Optionally, the protective liner 144 and protective liner tab **144*a* on the adhesive 136, 136*a* are removed simultaneously to expose the adhesive 136, 136*a*. The display region 134 is applied to the end 130 and then fastened around the wrist of the user by adhesive 136 being placed in adhesive contact with the ink pattern 132. The latent information contained in the pattern 132 on the wrist band 110 bleeds through to opaque layer 138, usually in the time period of one day, producing a plurality of spaced apart bars 135 in the display region 134**. The self-expired wrist band is thus incapable of being transferred for subsequent use at a subsequent time.

In all of the embodiments described herein which use an adhesive, almost any adhesive which is receptive to dyes or inks can be used. An adhesive that is "receptive" is an adhesive that is capable of dissolving an ink, thereby causing the ink to migrate away from a point of application. By adding polar and/or non-polar materials to the adhesive, the adsorption properties of the adhesive can be altered.

Preferred materials are from Avery Company, Fasson Films Division, Painesville, Ohio. A preferred standard adhesive is No. 287, manufactured by H & N Chemical Adhesives. Adding an organic, such as a plasticizer, to the adhesive increases the rate of migration. Typically, a plasticizer is added when the identification band is used in cold environments, while the standard adhesive is suitable for environments over 60° F.

Preferred inks for use with this invention are from Gans Ink Company, Los Angeles, Calif. In particular PYRO-SCRIPT Sublimation Inks, e.g., Ink Nos. 57977, 57976, Heat Transfer Inks, TURN-A-BOUT, SUNRISE Process, SUNBURST Process and TURN-A-BOUT R.S. series inks. Other manufacturers include Superior Ink Co. in New York and Proflexo. Sublimation and heat transfer type inks are generally low molecular weight dyes that can bleed. Standard inks which do not bleed include particles, i.e., finely ground non-migrating solids (vis-a-vis molecules) which provide deep colors.

The identification bands may also include a hologram, for example, overlaying or intertwined with the printed pattern 32, 132 or embedded within the display region 34, 134. Such holograms assist in preventing counterfeiting of the bands.

The time indicator systems that can be used in the identification bands of this invention, e.g., self-expiring wristbands, are any of the previously described systems. In particular, those systems described in U.S. Pat. Nos. 4,212,153 to Kydonieus et al; 5,107,470 to Pedicano; as well as all of applicant's time indicator systems as described in U.S. Pat. Nos. 4,432,630; 4,542,982; 4,779,120; 4,903,254; 5,058,088; 5,364,132; 5,446,705, and applicant's now pending applications U.S. Ser. No. 07/602,120 filed on Oct. 22, 1990, now U.S. Pat. No. 5,719,828; U.S. Ser. No. 07/771,765 filed on Oct. 4, 1991, now U.S. Pat. No. 5,699,326; U.S. Ser. No. 07/955,469 filed on Oct. 2, 1992, now U.S. Pat. No. 5,715,215; U.S. Ser. No. 08/197,631 filed on Feb. 10, 1994, now U.S. Pat. No. 5,633,835; U.S. Ser. No. 03/510,762, filed on Aug. 3, 1995, now U.S. Pat. No. 5,602,804; all to Haas. The entire disclosures of all of these U.S. patents and applications are incorporated herein by reference.

This invention enables any paper or plastic wristband to be made to self-expire by changing color after a predetermined period of time. Because the color change is clearly visible, it immediately alerts the ticket taker or security officer that the band has expired.

A self-expiring wristband offers substantial benefits over non-expiring wristbands. For example, cutting, removing, and reattaching the wristband is eliminated. Once the wristband has changed color and is 'EXPIRED', it is not relevant whether one removes and reattaches the wristband, because the expired indicator remains, for example, with exposed "bars", the color RED, etc. Once the expiration has occurred, the wristband is essentially destroyed. Additionally, such self-expiring wristbands eliminate the need for different colored wristbands. By eliminating the need for different colors of wristbands, the user only has to maintain a supply of one color hands, rather than a different color for each day of the week. This is a substantial financial benefit for the user and purchaser of the wristbands. Still further, because the wristbands "expire", the use of wristbands from different locations or previous times is defeated.

It is understood that the embodiments described herein are merely exemplary and that a person skilled in the art may make many variations and modifications without departing from the spirit and scope of the invention. All such modifications and variations are intended to be included within the scope of the invention as defined in the appended claims.

I claim:

1. An identification band comprising:

an elongated band having an outer surface and an inner surface and first and second ends;

a first chemical composition on the outer surface of the band proximate the first end;

a display region associated with the band proximate the second end, the display region including an opening therethrough;

a second chemical composition on the inner surface of the band on a layer overlying the opening through display region proximate the second end;

wherein when the band is wrapped around an object with the outer surface exposed, the outer surface of the first end and the inner surface of the second end overlay and are in contact with each other, the first and second chemical compositions coacting to cause a visually perceptible change in the display region after a predetermined time interval, such visually perceptible change viewable through the opening from the outer surface.

2. The identification band of claim 1, wherein the opening in the display region comprises a substantially transparent layer overlying the opening.

3. The identification band of claim 2, wherein the chemical compositions are an ink dissolver and an ink, the ink dissolver coacting with the ink to cause a migration of the ink into the display region.

4. The identification band of claim 3, wherein the ink dissolver is an adhesive and the outer surface of the first end and the inner surface of the second end form an adhesive bond with each other.

5. The identification band of claim 4, wherein the adhesive bond is tamper-evident to provide a visible indication of tampering with the adhesive bond.

6. The identification band of claim 3, wherein the opening in the display region comprises an opaque viewing layer overlying the opening that absorbs the ink to provide a visually perceptible change therein after a predetermined time interval.

7. The identification band of claim 1, wherein the first composition is a soluble ink pattern printed on the outer surface and the second chemical composition is an adhesive activator, wherein when the outer surface of the first end and the inner surface of the second end overlay and are in adhesive contact with each other, the ink and the adhesive activator coact to cause the soluble ink pattern to gradually bleed and blend together along the surfaces of the band to cause a visually perceptible change in the display region after a predetermined time interval.

8. The identification band of claim 7, wherein the ink pattern comprises a uniform array of dots.

9. The identification band of claim 7, wherein the ink pattern has a substantially uniform distribution of dots with a predetermined dot-to-dot distance.

10. The identification band of claim 7, wherein the ink pattern comprises a plurality of parallel bars.

* * * * *